US009356362B2

(12) United States Patent
Miyawaki et al.

(10) Patent No.: US 9,356,362 B2
(45) Date of Patent: May 31, 2016

(54) COMPONENT UNIT

(71) Applicant: Yazaki Corporation, Tokyo (JP)

(72) Inventors: Koji Miyawaki, Susono (JP); Kunihiko Yamada, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/676,185

(22) Filed: Apr. 1, 2015

(65) Prior Publication Data

US 2015/0288082 A1 Oct. 8, 2015

(30) Foreign Application Priority Data

Apr. 7, 2014 (JP) ..... 2014-078402

(51) Int. Cl.

| | |
|---|---|
| ***H01R 4/34*** | (2006.01) |
| ***H01R 13/46*** | (2006.01) |
| ***H01R 4/64*** | (2006.01) |
| ***H01R 13/405*** | (2006.01) |
| ***H01R 31/08*** | (2006.01) |
| *H01R 13/719* | (2011.01) |

(52) U.S. Cl.
CPC .. *H01R 4/34* (2013.01); *H01R 4/64* (2013.01); *H01R 13/405* (2013.01); *H01R 31/085* (2013.01); *H01R 13/719* (2013.01)

(58) Field of Classification Search
CPC ..... H01R 4/64; H01R 4/34; H01R 31/085; H01R 13/405
See application file for complete search history.

(56) References Cited

U.S. PATENT DOCUMENTS

2002/0006743 A1* 1/2002 Kanagawa ..... H01R 13/6592 439/98
2008/0304211 A1 12/2008 Shimizu

FOREIGN PATENT DOCUMENTS

JP 2008-306839 A 12/2008

* cited by examiner

*Primary Examiner* — Briggitte R Hammond
(74) *Attorney, Agent, or Firm* — Locke Lord LLP

(57) ABSTRACT

A component unit is provided that achieves both downsizing of a bracket and prevention of deformation of the bracket that occurs when tightening the bolt. A noise filter, which is the component unit, includes a housing made of a synthetic resin and a bracket made of a metal and attached to a vehicle panel with a bolt. The bracket is attached to the housing by insert forming. The portion of the bracket projecting outside the housing is provided with a bolt through hole. The portion of the bracket embedded in the housing is provide with a resin introducing hole through which a resin of the housing flows during insert forming. With this configuration, the bracket, the resin around the bracket, and the rein in the resin introducing hole together receive an external force generated by tightening the bolt.

4 Claims, 8 Drawing Sheets

COMPONENT UNIT

TECHNICAL FIELD

The present invention relates to a component unit such as a noise filter and a joint connector.

BACKGROUND ART

A conventional component unit, such as a component unit illustrated in FIG. 8, is known that includes a housing made of a synthetic resin and a metal bracket attached to the housing, and secured to a target portion with a bolt (refer to Patent Literature 1).

A component unit 502 illustrated in FIG. 8 is connected to an electric wire 501 constituting a wire harness of an automobile and configured to remove electrical noise in the electric wire 501. The component unit 502 includes a housing 507 made of a synthetic resin, a bracket 510 attached to the housing 507, a clamp 511 attached to the bracket 510, a capacitor contained in the housing 507, a metal attachment that electrically connects the capacitor and the electric wire 501, etc.

The bracket 510 is formed, for example, by press forming of a metal plate. The bracket 510 is provided with parts such as an earth portion 549 which is laid on a target portion, such as a vehicle panel, and an engagement portion 551 which is formed into a frame-shape and engages with a protrusion 533 provided on a side face of the housing 507. The bracket 510 is attached to the housing 507 by the engagement portion 551 that engages with the protrusion 533. A bolt through hole 548 is provided in the earth portion 549. By tightening a bolt inserted through the bolt through hole 548 and screwed to the target portion, the component unit 502 is secured to the target portion and at the same time, the earth portion 549 is grounded.

Before securing the bracket 510 on the target portion, a clamp 511 is press fit in a hole provided in the target portion. By press fitting the clamp 511 in the hole, the component unit 502 is temporarily secured to the target portion.

CITATION LIST

Patent Literature

Patent Literature 1: JP 2008-306839 A

SUMMARY OF INVENTION

Technical Problem

As for the component unit illustrated in FIG. 8, for example, the downsizing of the bracket is desired for various reasons. For example, the downsizing of the bracket of the component unit 502 illustrated in FIG. 8 is necessary to reduce the distance between the capacitor and the target portion (ground) in order to improve de-noising performance. The disadvantage is that the downsized bracket is easy to deform by a torque generated by tightening a bolt.

Accordingly, an object of the present invention is to provide a component unit that achieves both downsizing of a bracket and prevention of deformation of the bracket that occurs when tightening a bolt.

Solution to Problem

The invention according to a first aspect is a component unit including a housing made of a synthetic resin and a bracket made of a metal material, formed into a plate shape with a bolt through hole and attached to the housing, and secured to a target portion with a bolt inserted through the bolt through hole. The component unit is characterized in that the bracket is attached to the housing by insert forming, and the bracket is provided with a resin introducing hole through which the resin of the housing flows during insert forming.

In the invention according to the first aspect, the invention according to a second aspect includes the resin introducing hole having a square shape in a plan view.

In the invention according to the first aspect or the second aspect, the invention according to a third aspect further includes a connecting portion connected to a wire harness, wherein the bracket is coupled to the ground.

Advantageous Effects of Invention

According to the invention according to the first and the third aspects, since the bracket is attached to the housing by insert forming and the bracket is provided with the resin introducing hole through which a resin of the housing flows during insert forming, the bracket, the resin surrounding the bracket, and the resin in the resin introducing hole together receive an external force applied when tightening a bolt. A component unit that achieves both downsizing of the bracket and prevention of deformation of the bracket that occurs when tightening the bolt is thus provided.

According to the invention according to the second aspect, since the resin introducing hole provided in a limited space on the bracket has a square shape in a plan view, the resin introducing hole has a large sectional area compared to a resin introducing hole having a circular shape in a plan view. Thus, the deformation of the bracket that occurs when tightening the bolt can further be prevented.

DESCRIPTION OF EMBODIMENT

A "component unit" according to one embodiment of the present invention will be described with reference to FIGS. 1 to 7. The "component unit" according to the embodiment constitutes a noise filter 1 illustrated in FIG. 1. The noise filter 1 is mounted on an automobile to remove electrical noise in an electric wire 12 of a wire harness.

Figure 1:
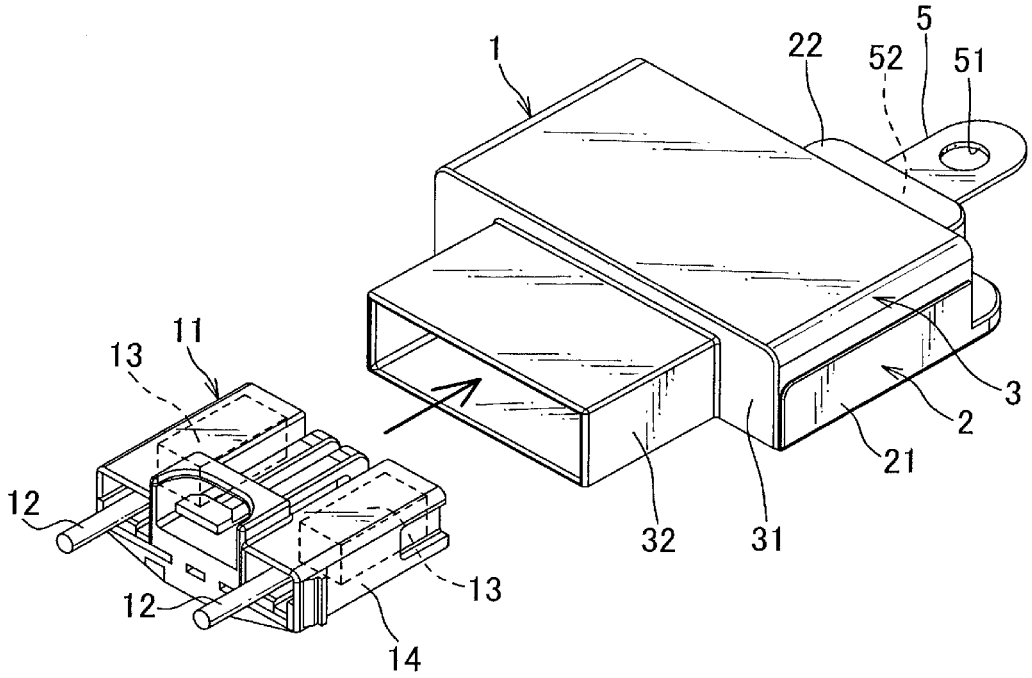
FIG. 1 is a perspective view of a noise filter, which is a component unit, according to one embodiment of the present invention.

A reference sign 11 in FIG. 1 refers to a connector provided at an end of the electric wire 12 of the wire harness. The connector 11 is configured with female terminals 13 each attached to each end of two electric wires 12 and a connector housing 14 containing the female terminals 13.

Figure 2:
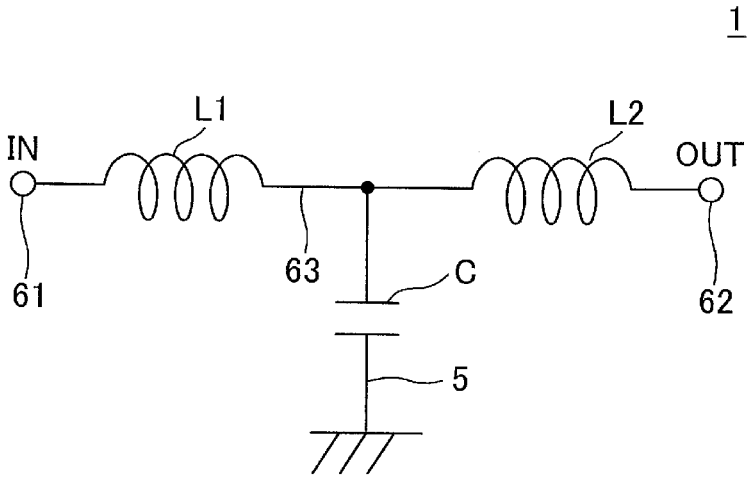
FIG. 2 is a circuit diagram of the noise filter illustrated in FIG. 1.

FIG. 2 illustrates a circuit diagram of the noise filter 1. A reference sign 61 refers to an input terminal ("connecting portion" in claims) engages with one of the terminals 13 of the connector 11. A reference sign 62 refers to an output terminal ("connecting portion" in claims) engages with the other one of the terminals 13 of the connector 11. A first inductance generator L1 and a second inductance generator L2 are connected in serial between the input terminal 61 and the output terminal 62. A reference sign 63 refers to a coupling part couples the first inductance generator L1 and the second inductance generator L2. The input terminal 61, the output terminal 62, and the coupling part 63 are integrally provided as one bus bar 6 (refer to FIG. 3). A reference sign C refers to a capacitor grounding the noise (high-frequency noise) in the coupling part 63. A reference sign 5 refers to a bracket coupled to the ground (a vehicle panel in the embodiment). In other words, the capacitor C is coupled to the ground via the bracket 5.

Now, the configuration of the noise filter 1 will be described. The housing 2 and the housing cover 3 are assembled to constitute the outer wall of the noise filter 1. The housing 2 and the housing cover 3 are formed of synthetic resin. The housing cover 3 is integrally provided with a main body 31 which covers the first inductance generator L1 and the second inductance generator L2 and a connecting sleeve 32 connected to the connector 11. The housing 2 is integrally provided with a main body 21 which covers, together with the main body 31 of the housing cover 3, the first inductance generator L1 and the second inductance generator L2 and an insertion part 22 embedding therein a portion of the bus bar 6 and a portion of the bracket 5.

Figure 3:
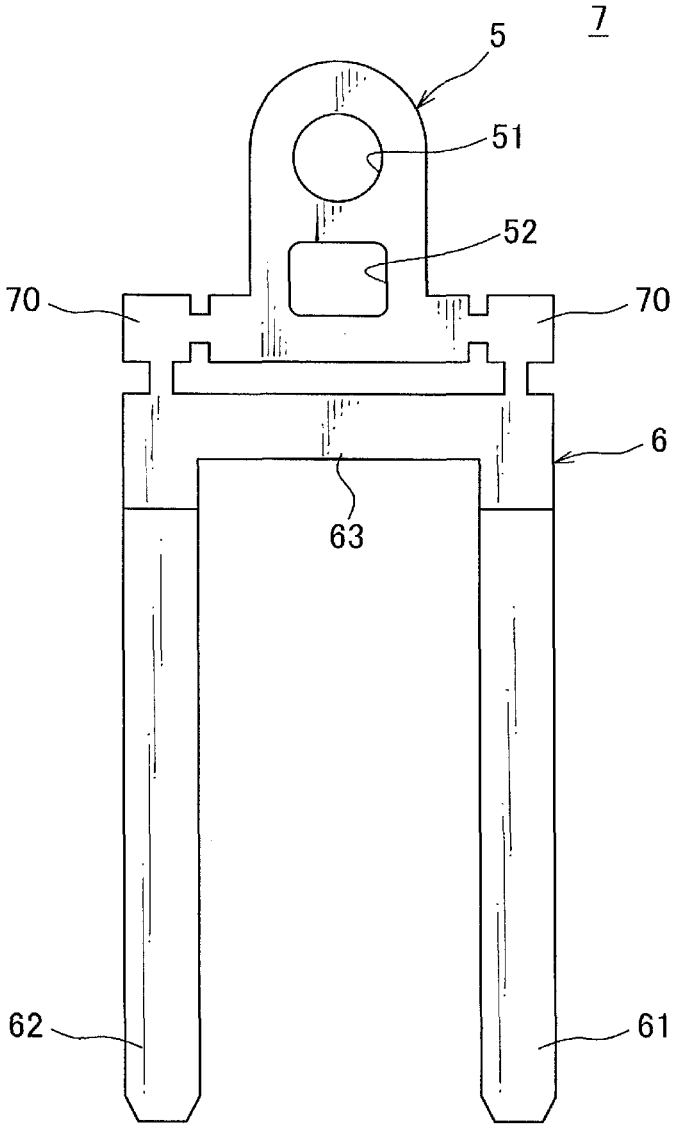
FIG. 3 is a plan view of an integrated bus bar part in which a bus bar used for the noise filter illustrated in FIG. 1 and the bracket are coupled via a bridge.

As described above, the noise filter 1 includes the bus bar 6, in which the input terminal 61, the output terminal 62, and the coupling part 63 is integrated, the bracket 5, a pair of ferrite core 8, and the capacitor C. As illustrated in FIG. 3, the bus bar 6 and the bracket 5 are integrated with the housing 2 by insert forming, being formed by punching metal sheet and connected with bridges 70. Hereinafter, the member composed of the bus bar 6, the bracket 5, and the bridges 70 connecting the bus bar 6 and the bracket 5 is referred to as an integrated bus bar part 7.

The bus bar 6 has the input terminal 61 and the output terminal 62 formed into elongate plate shapes that are parallel to each other. An end of the input terminal 61 and an end of the output terminal 62 are connected to the coupling part 63.

Figure 4:
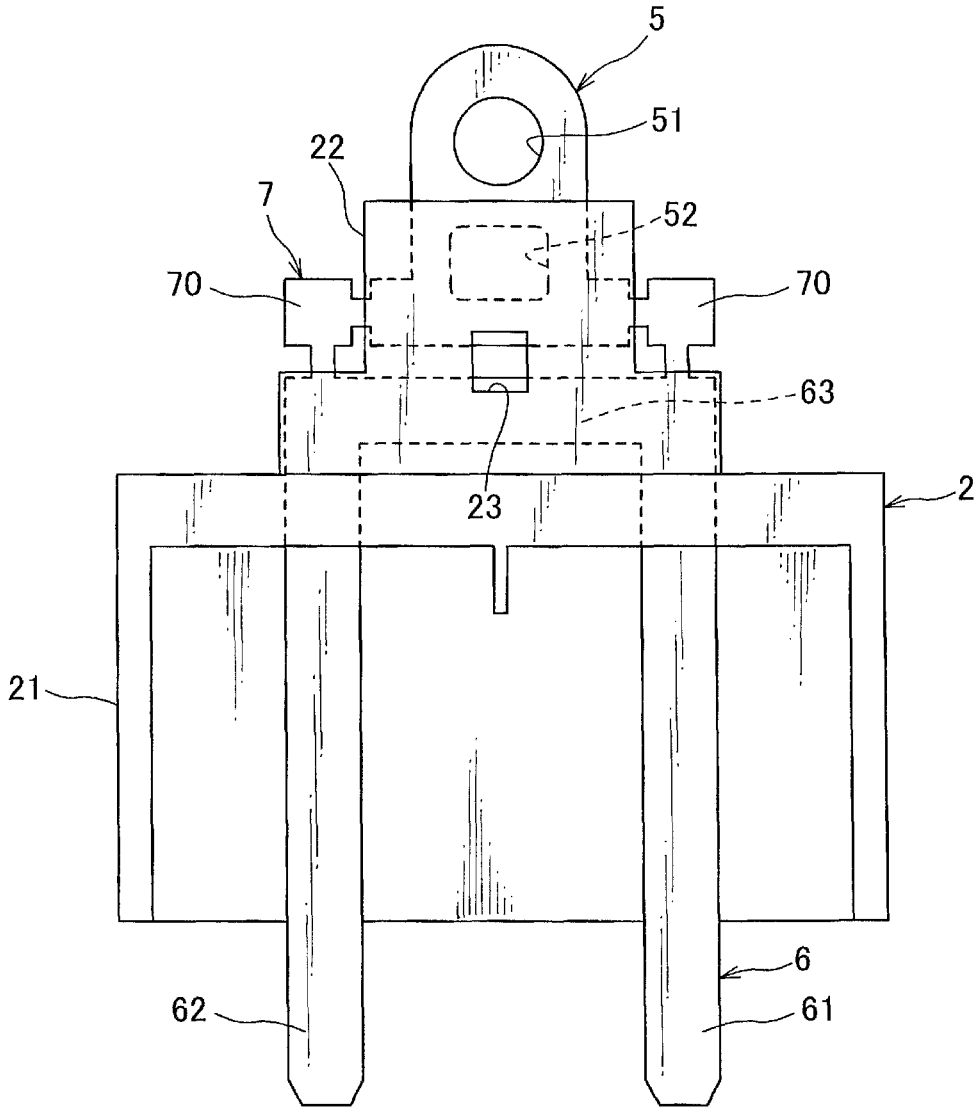
FIG. 4 illustrates the integrated bus bar part illustrated in FIG. 3 integrated with a housing by insert forming.

The bracket 5 is formed into a plate shape and includes two holes 51 and 52. One is a bolt through hole 51 provided in a portion projecting outward from the housing 2 of the bracket 5 as illustrated in FIG. 4. The bolt through hole 51 has a circular shape in a plan view and is used to secure the noise filter 1 to a vehicle panel with a bolt. The other one is a resin introducing hole 52 provided in a portion embedded in the insertion part 22 of the housing 2. In insert forming, a resin of the housing 2 flows through the resin introducing hole 52. The resin introducing hole 52 has a square shape in a plan view.

The bus bar part 7 is integrated with the housing 2 by insert forming as illustrated in FIG. 4. The entire portion of the coupling part 63 of the bus bar 6 is embedded in the insertion part 22. The input terminal 61 and the output terminal 62 extend through the main body 21 to the outside of the housing 2. The portion of the bracket 5 where the resin introducing hole 52 is provided is embedded in the insertion part 22 as described above. The coupling part 63 and the bracket 5 are disposed in the insertion part 22 with a gap therebetween.

Figure 5:
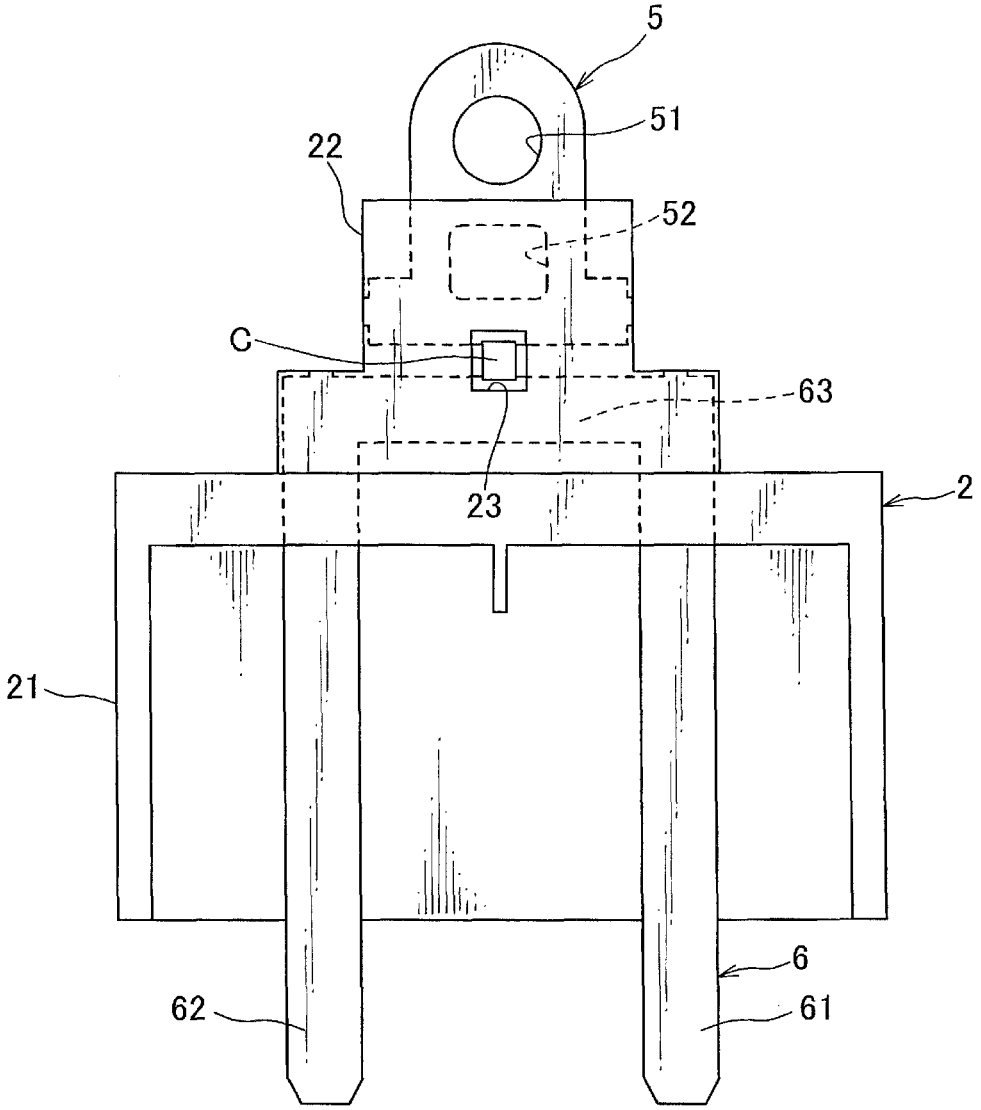
FIG. 5 illustrates the integrated bus bar part illustrated in FIG. 4 after cutting off the bridge.

The insertion part 22 is provided with a recessed portion 23 through which a portion of the coupling part 63 and a portion of the bracket 5 are exposed. As illustrated in FIG. 5, the capacitor C is inserted in the recessed portion 23 and fixed with solder to the coupling part 63 and the bracket 5. After fixing the capacitor C with solder, the recessed portion 23 is filled with resin. After taken out of a forming die of the housing 2, the bridge 70 of the integrated bus bar part 7 is cut off as illustrated in FIG. 5.

Figure 6:
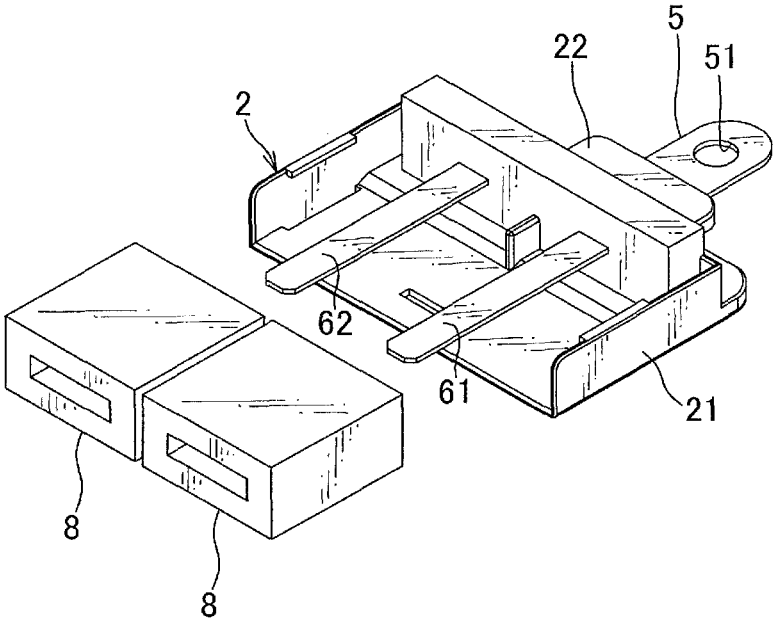
FIG. 6 illustrates ferrite cores being attached to the bus bar illustrated in FIG. 5.
Figure 7:
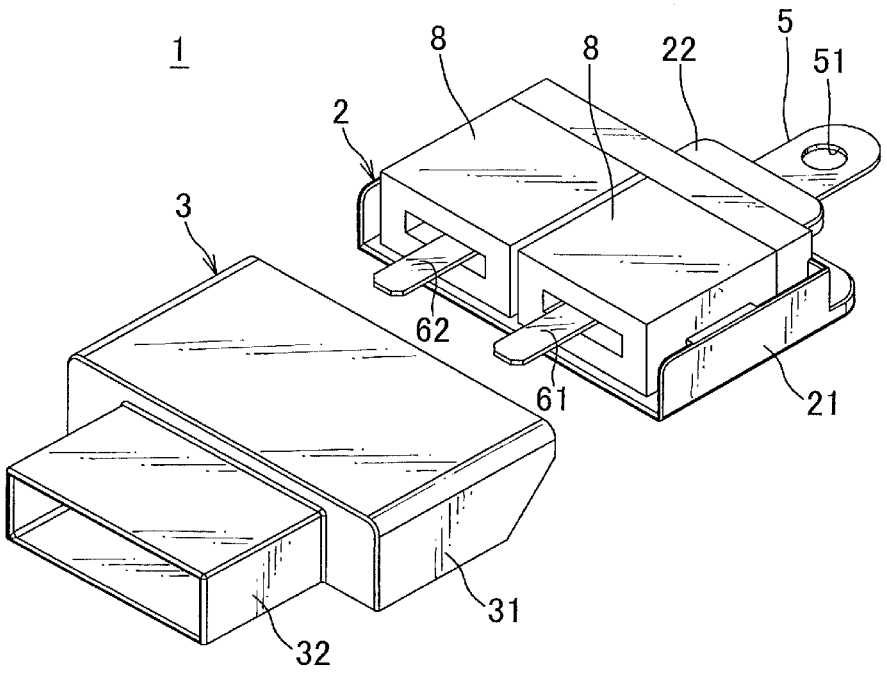
FIG. 7 illustrates a housing cover assembled to the housing illustrated in FIG. 6.

A pair of ferrite cores 8 is formed into a square-tube shape as illustrated in FIG. 6. After the bus bar 6 is attached to the housing 2, the pair of ferrite cores 8 is attached to the main body 21 so as to surround the outer periphery of the input terminal 61 and the output terminal 62 as illustrated in FIG. 7. One of the ferrite cores 8 and the input terminal 61 constitute the first inductance generator L1. The other one of the ferrite cores 8 and the output terminal 62 constitute the second inductance generator L2.

After attaching the pair of ferrite cores 8 to the housing 2, the housing cover 3 is attached to the housing 2. The housing cover 3 has a lance that engages with the housing 2 to secure the housing cover 3 to the housing 2. When the housing cover 3 is assembled to the housing 2 as described above, a portion of the input terminal 61 projecting out of the ferrite core 8 and a portion of the output terminal 62 projecting out of the ferrite core 8 are positioned inside the connecting sleeve 32.

The bracket 5 is laid on the vehicle panel so as to position the bolt through hole 51 on a hole provided in the vehicle panel, and a bolt is inserted through the bolt through hole 51 and the hole in the vehicle panel and then screwed into a nut or the like, thereby securing the noise filter 1, configured as described above, to the vehicle panel and at the same time, the bracket 5 is grounded.

Figure 8:
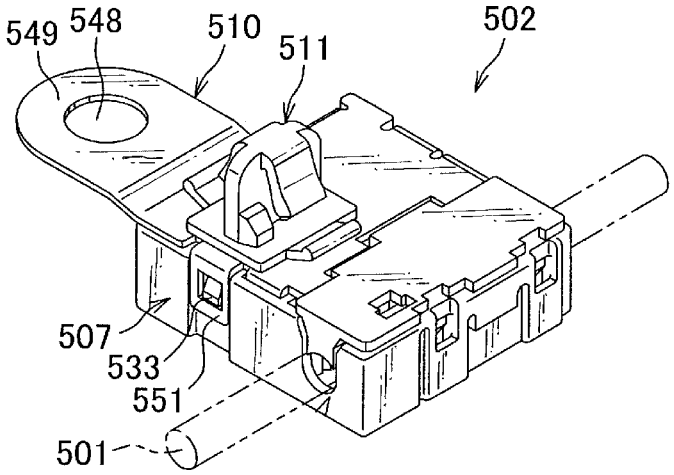
FIG. 8 PRIOR ART
FIG. 8 is a perspective view of a conventional component unit with a bracket attached to a housing.

The noise filter 1 has the bracket 5 which is smaller in size than a conventional bracket (refer to FIG. 8, etc.) so as to reduce the distance from the capacitor C to the vehicle panel (ground) to improve de-noising performance. The rigidity of the bracket 5 is smaller than the conventional bracket because the bracket 5 is made small in size. However, with the bracket 5 insert formed in the housing 2 and provided with the resin introducing hole 52, the bracket 5, the resin around the bracket 5, and the resin in the resin introducing hole 52 can together receive the external force generated by tightening the bolt. Thus, the noise filter 1 achieves both downsizing of the bracket 5 and prevention of deformation of the bracket 5 that occurs when tightening the bolt.

Since the noise filter 1 includes the resin introducing hole 52 having a square shape in a plan view, the sectional area of the resin introducing hole 52 is large compared to a resin introducing hole 52 having a circular shape in a plan view. For example, if a resin introducing hole having a circular shape with a maximum diameter of 10 mm in a plan view can be provided in the bracket 5, a square resin introducing hole of 10 mm by 10 mm in a plan view, which has a larger sectional area, can be provided in the bracket 5 of the same size. In addition, by increasing the sectional area of the resin introducing hole 52, the deformation of the bracket 5 that occurs when tightening a bolt can further be prevented.

In the embodiment described above, a clamp for temporary securing (refer to a clamp 511 in FIG. 8) is not provided to the noise filter 1. However, a clamp may be provided to the housing 2 or the housing cover 3 as required. In such case, the clamp is press inserted in a clamp hole in the vehicle panel so that the bolt can be tightened with the noise filter 1 temporarily secured to the vehicle panel. This provides high operability.

In the embodiment described above, the "component unit" composes the noise filter 1. However, the component unit according to the present invention is not limited to the noise filter 1 and may be a component unit that includes a housing made of a synthetic resin, and a bracket made of a metal material, formed into a plate shape, provided with a bolt through hole, and attached to the housing, such as a joint connector (a connector for coupling a plurality of wirings with each together)

The embodiment described above is merely an illustrative representation of the present invention, and should not be construed to limit the scope of the present invention. Various modifications may be made without departing from the scope of the present invention.

REFERENCE SIGNS LIST

1 noise filter (component unit)
2 housing
5 bracket
51 bolt through hole
52 resin introducing hole

The invention claimed is:

1. A component unit comprising:

a housing made of a synthetic resin, comprising: a main body; and an insertion part; and a bracket made of a metal material, formed into a plate shape, provided with a bolt through hole and a resin introducing hole, embedded partially in the insertion part of the housing, and attached to the housing by insert forming, the component unit being secured to a target portion with a bolt inserted through the bolt through hole, wherein the resin introducing hole is filled with the resin of the housing.

2. The component unit according to claim 1, wherein the resin introducing hole has a square shape in a plan view.

3. The component unit according to claim 1, further comprising a connecting portion connected to a wire harness, wherein the bracket is coupled to ground.

4. The component unit according to claim 2, further comprising a connecting portion connected to a wire harness, wherein the bracket is coupled to ground.

* * * * *